US008342985B2

(12) United States Patent
Hirano

(10) Patent No.: US 8,342,985 B2
(45) Date of Patent: Jan. 1, 2013

(54) IRON-TYPE GOLF CLUB HEAD

(75) Inventor: Tomoya Hirano, Kobe (JP)

(73) Assignee: SRI Sports Limited, Kobe (JP)

( * ) Notice: Subject to any disclaimer, the term of this patent is extended or adjusted under 35 U.S.C. 154(b) by 304 days.

(21) Appl. No.: 12/412,824

(22) Filed: Mar. 27, 2009

(65) Prior Publication Data

US 2009/0305815 A1 Dec. 10, 2009

(30) Foreign Application Priority Data

Jun. 6, 2008 (JP) ..... 2008-149557

(51) Int. Cl.
*A63B 53/00* (2006.01)

(52) U.S. Cl. ..... 473/350; 473/331

(58) Field of Classification Search ..... 473/331, 473/332, 350, 349, 334–339, 344; *A63B 53/00*
See application file for complete search history.

(56) References Cited

U.S. PATENT DOCUMENTS

| | | | | |
|---|---|---|---|---|
| 4,645,207 | A * | 2/1987 | Teramoto et al. | 473/290 |
| 4,824,110 | A * | 4/1989 | Kobayashi | 473/332 |
| 4,836,550 | A * | 6/1989 | Kobayashi | 473/350 |
| 5,616,088 | A * | 4/1997 | Aizawa et al. | 473/341 |
| 5,669,826 | A * | 9/1997 | Chang et al. | 473/332 |
| 5,833,551 | A * | 11/1998 | Vincent et al. | 473/350 |
| 6,379,265 | B1 * | 4/2002 | Hirakawa et al. | 473/338 |
| 6,440,010 | B1 * | 8/2002 | Deshmukh | 473/335 |
| 6,554,719 | B2 * | 4/2003 | Peters et al. | 473/291 |
| 6,638,183 | B2 * | 10/2003 | Takeda | 473/335 |
| 7,140,976 | B2 * | 11/2006 | Chen et al. | 473/334 |
| 7,147,571 | B2 * | 12/2006 | Best et al. | 473/291 |
| 7,182,698 | B2 * | 2/2007 | Tseng | 473/332 |
| 7,316,623 | B2 * | 1/2008 | Imamoto | 473/332 |
| 7,530,902 | B2 * | 5/2009 | Nakamura | 473/334 |
| 8,157,673 | B2 * | 4/2012 | Gilbert et al. | 473/350 |
| 2005/0049075 | A1 * | 3/2005 | Chen et al. | 473/338 |
| 2007/0037634 | A1 * | 2/2007 | Lai | 473/349 |
| 2007/0105657 | A1 * | 5/2007 | Hirano | 473/345 |

FOREIGN PATENT DOCUMENTS

| | | | |
|---|---|---|---|
| GB | 2200558 | * | 8/1998 |
| JP | 09285576 | * | 11/1997 |
| JP | 10127832 | * | 5/1998 |
| JP | 10201883 | * | 8/1998 |
| JP | 2001170222 | * | 6/2001 |
| JP | 2002143356 | * | 5/2002 |
| JP | 3089247 U | | 10/2002 |
| JP | 2007151851 | * | 6/2007 |

* cited by examiner

*Primary Examiner* — Gene Kim
*Assistant Examiner* — Matthew B Stanczak
(74) *Attorney, Agent, or Firm* — Birch, Stewart, Kolasch & Birch, LLP

(57) ABSTRACT

An iron-type golf club head 1 having excellent durability and weight distribution design and comprising a metallic head body 1A having a face 2 for hitting a golf ball and a recess portion 13, and a metallic weight member 1B having a larger specific gravity than the head body 1A, the member 1B being fitted to and welded to the recess portion to form a part of the outer surface of the head body 1A, wherein at least one closed space 14 surrounded by the weight member 1B and the surface of the recess portion 13 is formed inside the head body.

8 Claims, 15 Drawing Sheets

IRON-TYPE GOLF CLUB HEAD

BACKGROUND OF THE INVENTION

The present invention relates to an iron-type golf club head having excellent durability and excellent weight distribution design.

In recent years are proposed iron-type golf club heads which are improved in location of the center of gravity of the heads by joining two or more kinds of members made of different metallic materials. An example of such iron-type golf club heads is shown in FIGS. 16A and 16B. This iron-type golf club head "a" comprises a head body "b" having a recess portion "d", for example, on a head bottom side, and a weight member "c" which is made of a metallic material having a larger specific gravity than the head body "b" and is fitted to the recess portion "d" of the body "b". Since a larger amount of weight can be allocated on the head bottom side, such a club head "a" has the advantage that the location of the club head's center of gravity is low and deep. A golf club head of this type is also disclosed in JP-U3089247.

The head body "b" and the weight member "c" are joined together, for example, by welding them in a state that the facing surfaces thereof are brought into substantial contact with each other. The welding is carried out by imparting a molten metal or a heat energy to the interface between the recess portion "d" and the weight member "c" from a head's periphery side.

However, as shown in FIG. 16B in an enlarged form, there may occur a case that the whole interface between the recess portion "d" and the weight member "c" is not completely welded by such a welding applied from the head's periphery. That is to say, a contact face "p" between the recess portion "d" and the weight member "c" may include a welded part "j" and a non-welded part "n" continuing the back of the welded part "j". In such a case, there is a possibility that the weight member is vibrated through the non-welded part "n" by impact of the head body "b" receiving at the time of hitting a golf ball or at the time of contacting the ground, thus resulting in generation of cracks at the welded part "j". Particularly, in the case that the recess portion "d" is deeply dented toward the inside of the head, or in the case of plasma or Tig welding that the depth of penetration of weld bead is relatively small, this tendency is noticeable.

In case of autogenous welding such as laser welding or plasma welding, it is desired that the weight member is in close contact with the surface of the recess portion "d" of the head body "b", in other words, there is no gap at the interface. However, since conventional club heads "a" are designed so that the whole facing surfaces of the recess portion "d" and the weight member "c" come into contact with each other, gaps are easy to generate at the contact surface to be welded due to variation in processing accuracy for the recess portion and the weight member, and may trigger a production of defective goods.

It is an object of the present invention to provide an iron-type golf club head which is improved in degree of freedom of weight distribution design while suppressing generation of cracks in a welded portion between the head body and the weight member over a long term.

This and other objects of the present invention will become apparent from the description hereinafter.

SUMMARY OF THE INVENTION

It has been found that a non-welded part at which the weight member and the recess portion of the head body are in contact with each other but are not welded together, is decreased to suppress transfer of vibration energy from the head body to the weight member by forming a closed space between the weight member and the surface of the recess portion of the head body and, therefore, generation of cracks in the welded part is prevented over a long term without lowering the joint strength between the head body and the weight member.

In accordance with the present invention, there is provided an iron-type golf club head comprising a head body which is made of a metallic material and which has a face for hitting a golf ball and a recess portion, and a weight member which is made of a metallic material having a larger specific gravity than the head body and which is fitted to and welded to the recess portion to form a part of the outer surface of the head body, wherein at least one closed space surrounded by the weight member and the surface of the recess portion is formed inside the head body.

The closed space can be formed on a head bottom side and/or a head upper side of the sweet spot of the head.

Preferably, the recess portion of the head and the weight member are welded at the entire region of a contact face between the recess portion and the weight member.

Preferably, the closed space has a gap of at least 0.1 mm between the opposing faces of the recess portion and the weight member.

The iron-type golf club head of the present invention has a closed space surrounded by the weight member and the surface of the recess portion formed to fit the weight member thereto. Such a closed space serves to reduce a contact surface between the weight member and the surface of the recess portion, thus reducing the non-welded portion as mentioned above. Therefore, vibration of the weight member generating at the time of hitting a ball can be reduced to improve the durability of the welded portion.

Since the closed space is not visible externally, it does not spoil the beauty of the club head. Further, foreign matters do not enter the closed space.

The location of the head's center of gravity can be changed by changing the location and size of the closed space. Further, a weight margin can be gained as a result of forming the closed space, and this weight margin can be allocated to another portion. Therefore, the degree of freedom of the weight distribution design for the club head can be effectively enhanced.

DETAILED DESCRIPTION OF THE INVENTION

Figure 1:
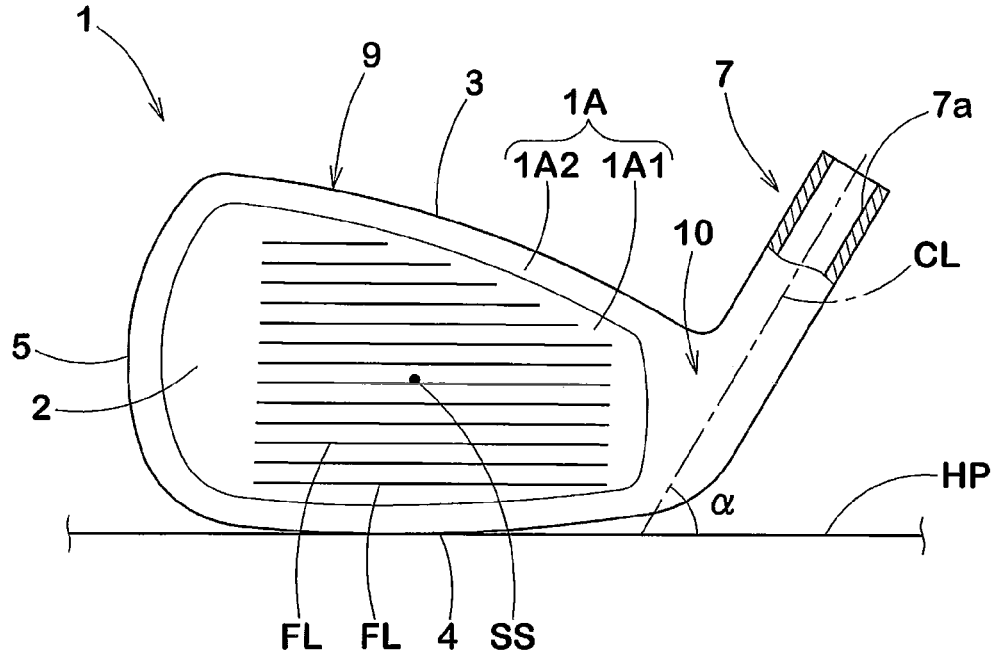
FIG. 1 is a front view of an iron-type golf club head in the standard state according to an embodiment of the present invention.

An embodiment of the present invention will now be explained with reference to the accompanying drawings.

FIGS. 1 to 7 show an iron-type golf club head 1 in the standard state according to an embodiment of the present invention.

The term "standard state" as used herein denotes the state that the club head 1 is placed on a horizontal plane HP with keeping prescribed lie angle $\alpha$ and loft angle $\beta$. The club head 1 referred to herein denotes that placed in the standard state unless otherwise noted.

The club head 1 includes a club face 2 for hitting a golf ball on its front side, a top 3 which intersects with the face 2 at its upper edge and forms the upper surface of the head 1, a sole 4 which intersects with the face 2 at its lower edge and forms the bottom surface of the head 1, a toe 5 connecting the top 3 and the sole 4 on the toe side with a smoothly curved line to form a toe portion of the head 1, a neck portion 10 connecting the top 3 and the sole 4 on the heel side, a back face 6 which is a face on the side opposite to the face 2, and a hosel portion 7 with a shaft inserting hole 7*a* for inserting a shaft (not shown). In the case that a shaft is not attached to the club head 1, the lie angle $\alpha$ of the head 1 can be determined based on the center line CL of the shaft inserting hole 7*a* in place of the center line of the shaft.

The club head 1 in this embodiment comprises a head body 1A made of a metallic material and having the face 2 for hitting a golf ball, and a weight member 1B made of a metallic material having a larger specific gravity than the head body 1A and welded to the head body 1A.

In this embodiment, the head body 1A is composed of a face member 1A1 in the form of a plate, and a head body main portion 1A2 which is made of a different metallic material from the face member 1A1 and serves as a receiving frame for fitting the face member 1A1 on the front side and for fitting the weight member 1B on the back side (the head body main portion 1A2 being hereinafter referred to as "head main portion 1A2"). The head body 1A may be made of a single metallic material by integral molding.

Preferably, the metallic material used for the face member 1A1 has a smaller specific gravity than the metallic material used for the head main portion 1A2, whereby more weight can be allocated to a peripheral portion of the face 2 to provide a golf club head having a large moment of inertia and a large sweet area and, therefore, having an excellent flight directionality of hit ball. Preferable examples of the metallic material used for the face member 1A1 are, for instance, an aluminum alloy, a titanium alloy and a manganese alloy. Preferable examples of the metallic material used for the head main portion 1A2 are, for instance, a stainless steel such as SUS630, SUS304 or SUS410, a carbon steel such as S20C or S25C, and a Fe-based alloy such as Fe—Mn—Al alloy.

The face member 1A1 in this embodiment is in the form of a plate having an approximately constant thickness "t" excepting the thickness of portions provided with an impact area marking such as face line grooves FL which may be provided as occasion demands. The face member 1A1 may have such a thickness as stepwise or continuously decreasing or increasing toward its center. A preferable contour of the face member 1A1 is such a shape that its height gradually increases from the heel side toward the toe side in conformity with the contour of the face 2, whereby a wider portion of the face 2 can be made up by a face member 1A1 having a low specific gravity.

The thickness "t" of the face member 1A1 is not particularly limited. However, if the thickness is too small, the durability tends to deteriorate, and if the thickness is too large, the repulsion property of the head 1 tends to deteriorate. Therefore, the thickness "t" is preferably at least 1.5 mm, more preferably at least 1.8 mm, still more preferably at least 2.0 mm, and is preferably at most 4.0 mm, more preferably at most 3.5 mm, still more preferably at most 3.0 mm.

Figure 5:
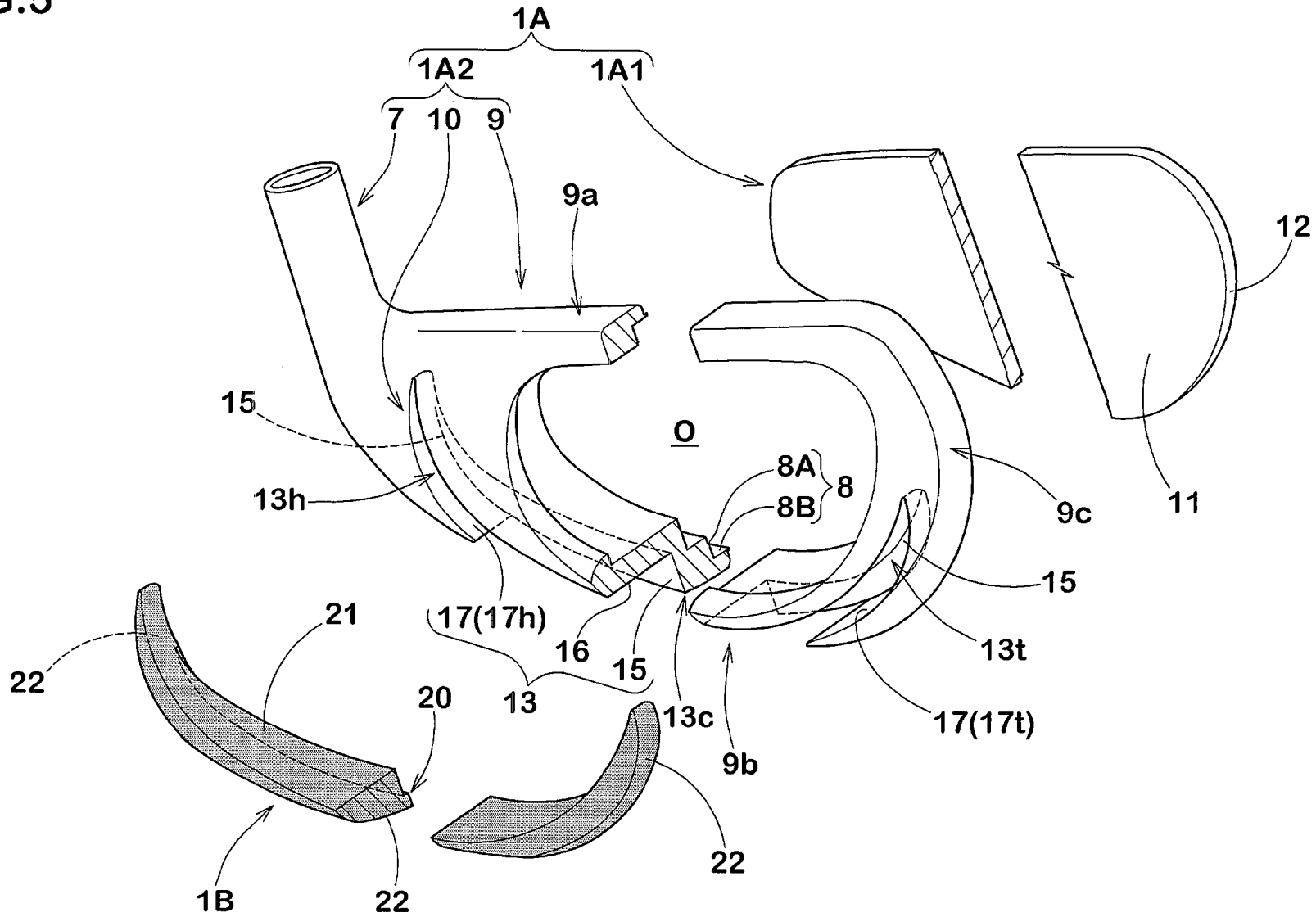
FIG. 5 is an exploded perspective view of the club head of FIG. 1 showing the state prior to assembling a head body main portion, a face member and a weight member.

The head main portion 1A2 includes a peripheral frame 9 provided with a face-fitting portion 8 for fitting the face member 1A1 as shown in FIG. 5, and the hosel portion 7 disposed continuously through the neck portion 10.

The frame 9 includes a top frame part 9*a* which extends obliquely downward in an upper portion of the head 1 from the toe side toward the heel side, a sole frame part 9*b* which extends in a lower portion of the head 1 in the toe-heel direction, a toe frame part 9*c* connecting the top frame part 9*a* and the sole frame part 9*b* on the toe side, a through-opening O which is surrounded by the top, toe and sole frame parts 9*a*, 9*c* and 9*b* and the neck portion 10 and which completely passes through in the front-back direction.

The face-fitting portion 8 is provided around the opening O on the front side of the frame 9. The face-fitting portion 8 is formed into an approximately step-like shape (L-shape in cross section) which includes an annular receiving surface 8A supporting a peripheral portion of a rear surface 11 of the face member 1A1, and an inner circumferential surface 8B extending from the peripheral edge of the receiving surface 8A toward the front side and supporting a peripheral surface 12 of the face member 1A1. The inner circumferential surface 8B has substantially the same contour as the peripheral surface 12 of the face member 1A1, and has substantially the same depth (width) as the thickness "t" of the face member 1A1. As a result of fitting the face member 1A1 to the face-fitting portion 8, the front side of the opening O is closed, thus providing a cavity surrounded by the peripheral frame 9 on the back side of the face member 1A1.

In this embodiment, a recess portion 13 for fitting the weight member 1B on the back side of the head main portion 1A2 is provided in the sole frame part 9*b* of the frame 9. The shape of the recess portion 13 is not particularly limited so long as it is a dent formed in the surface of the head main portion 1A2 to provide a part of the surface of the finished head 1 when the weight member 1B is fitted into the dent. For example, the recess portion 13 may be an annular recess disposed in a peripheral portion of the opening O.

Figure 2:
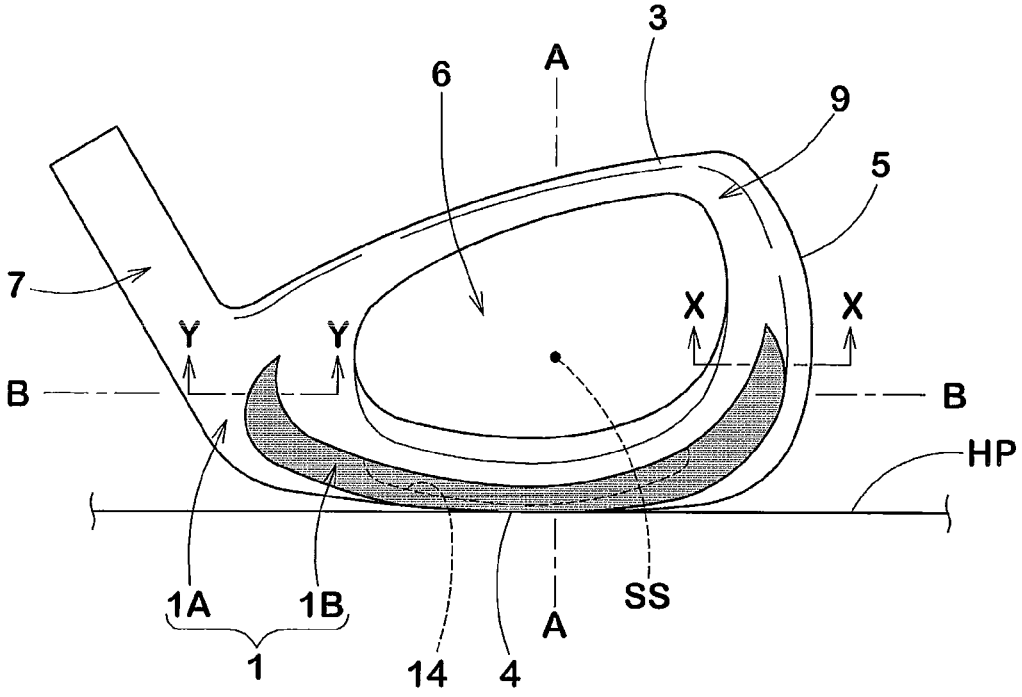
FIG. 2 is a back view of the club head of FIG. 1.

As shown in FIGS. 2 and 5, the recess portion 13 in this embodiment is located on a head bottom side of a sweet spot SS of the head 1. In this case, the volume centroid of a closed space 14 is located downward of the sweet spot SS. The term "sweet spot" SS denotes a point where a normal line N drawn to the face 2 from the center of gravity G of the club head 1 intersects the face 2. The recess portion 13 has an approximately circular arc shape smoothly curved along the shape of the opening O, and extends toward both the toe and heel sides with respect to the sweet spot SS.

The recess portion 13 in this embodiment can be divided, based on its cross sectional shape, into three portions, i.e., a center recess portion 13*c* extending on an approximately middle region of the recess portion 13 in the toe-heel direction, a toe side recess portion 13*t* continuous with the toe side end of the center portion 13*c*, and a heel side recess portion 13*h* continuous with the heel side end of the center portion 13*c*.

The center recess portion 13*c* extends in the toe-heel direction at the sole frame part 9B. The outer circumferential surface of the sole frame part 9B is cut away so that the sole side of the center recess portion 13*c* is also opened to the outside. Thus, the center recess portion 13*c* is in the form of a reentrant part that both its head bottom side and its head back side are opened. The surface of the center recess portion 13*c* includes a bottom surface 15 which is substantially parallel to the face 2, and an inner wall surface 16 extending from an inner edge of the bottom surface 15 toward the back side of the head. In this embodiment, the inner wall surface 16 extends from the bottom surface 15 at substantially a right angle.

Figure 6A:
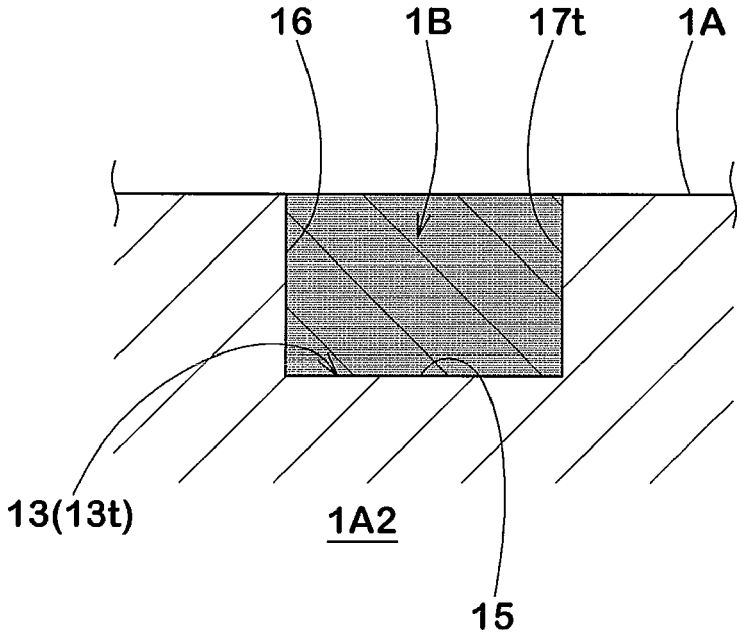
FIG. 6A is a cross sectional view along the line X-X of FIG. 2.
Figure 6B:
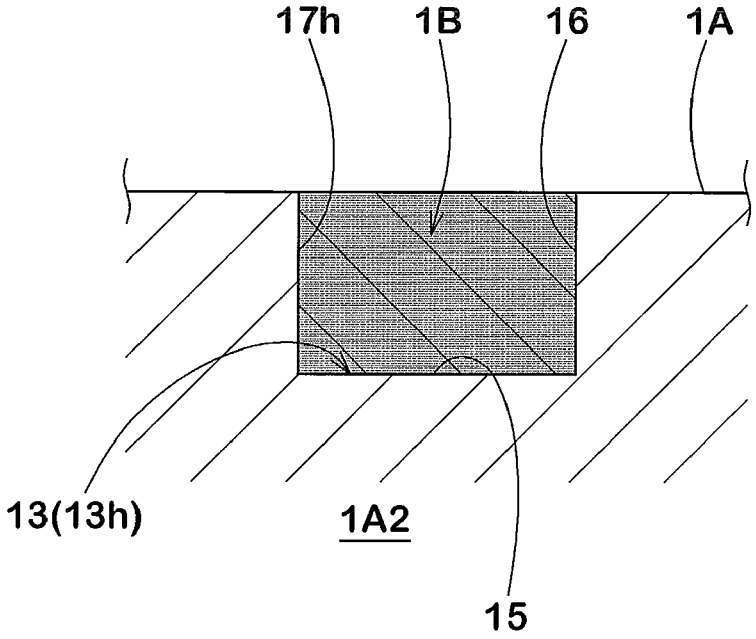
FIG. 6B is a cross sectional view along the line Y-Y of FIG. 2.

As apparent from FIGS. 6A and 6B showing schematic cross section views along the line X-X and the line Y-Y of FIG. 2, the toe side recess portion 13*t* extends in the toe frame part 9*c*, and the surface thereof is composed of the bottom surface 15, the inner wall surface 16 and a toe side outer wall surface 17*t* extending from an outer edge of the bottom surface 15 toward the head back side. That is to say, the toe side recess portion 13*t* has a nearly box-shape section (rectangle whose one side located on the head back side is cut away). The toe side recess portion 13*t* has a tapered end portion that the width in cross section decreases toward the tip.

Similarly, the heel side recess portion 13*h* extends toward the neck portion 10, and the surface thereof is composed of the bottom surface 15, the inner wall surface 16 and a heel side outer wall surface 17*h* extending from an outer edge of the bottom surface 15 toward the head back side. That is to say, the heel side recess portion 13*h* has a nearly box-shape section (rectangle whose one side located on the head back side is cut away). The heel side recess portion 13*h* has a tapered end portion that the width in cross section decreases toward the tip.

The outer wall surfaces 17*t* and 17*h* extend from the bottom surface 15 at substantially a right angle.

The weight member 1B is prepared from a metallic material having a larger specific gravity than the head body 1A, in other words, a metallic material having a larger specific gravity than the face member 1A1 and the head main portion 1A2. The head's center of gravity can be allocated to a desired location by attaching a weight member 1B made of such a high specific gravity material to the head body 1A. In this embodiment, since such a weight member 1B is fitted into the recess portion 13 as explained above, the center of gravity G of the head 1 can be located at a backward and lower portion of the head 1.

The metallic materials used for the weight member 1B must be weldable with the head main portion 1A2 to which the weight member 1B is attached. Such metallic materials are not particularly limited, but are selected in accordance with the kind of the metallic material used for the head main portion 1A2. For example, when the head main portion 1A2 is prepared from a steel material such as stainless steel or a soft iron (low carbon steel), a tungsten alloy containing iron and/or nickel such as W—Fe—Ni alloy is preferably used as a material of the weight member 1B.

Preferable tungsten alloys are those containing 15 to 50% by weight of W, 12 to 30% by weight of Fe and 30 to 69% by weight of Ni. If the W content is less than 15% by weight, the specific gravity is not increased as desired. If the W content is more than 50% by weight, the fluidity is lowered and, therefore, there is a possibility that it becomes difficult to form the weight member with a high accuracy by casting. If the Fe content is less than 12% by weight, welding to a head main portion 1A2 made of a steel material tends to become difficult, and if the Fe content is more than 30% by weight, the corrosion resistance tends to be deteriorated. If the Ni content is less than 30% by weight, the corrosion resistance tends to be deteriorated, and if the Ni content is more than 69% by weight, the strength and the specific gravity tend to lower.

In order to effectively conduct adjustment of location of head's center of gravity G, it is preferable that the metal material used for the weight member 1B has a specific gravity of at least 8.5, especially at least 9.0. On the other hand, if the specific gravity of the weight member 1B is too large, the material cost tends to increase. Accordingly, it is preferable that the specific gravity of the weight member 1B is at most 13.0, especially at most 12.5.

The weight member 1B can be prepared by various methods such as casting, forging, cutting, sintering and the like. Casting is particularly preferred since precise forming is possible.

The weight of the weight member 1B is not particularly limited. However, if the weight is too small, an effect of adjusting the center of gravity location is not sufficiently obtained, and if the weight is too large, allocation of weight to the head main portion 1A2 is limited and, therefore, there may occur a case that the club head 1 must be downsized. From such points of view, it is preferable that the weight of the weight member 1B is at least 30 g, especially at least 40 g, more especially at least 45 g, and is at most 100 g, especially at most 90 g, more especially at most 80 g.

The weight member 1B has a shape corresponding to the shape of the recess portion 13 of the head main portion 1A2. The weight member 1B in this embodiment is formed into an approximately arc shape that a middle portion extends in the toe-heel direction and both end portions extend upward in a smooth curve. Specifically, the weight member 1B has a rear surface 20 which faces and is in contact with the bottom surface 15 of the recess portion 13, an inside-facing surface 21 which faces and is in contact with the inner wall surface 16 of the recess portion, and an outside-facing surface 22 which faces and is in contact with the outer wall surfaces 17*t* and 17*h* of the toe and heel side recess portions 13*t* and 13*h* and which partly forms a part of the sole surface 4 (a part of the outer surface of the head body 1). In order to enable insertion of the weight member 1B into the recess portion 13 by a slight force such as finger force, it is preferable to form the weight member 1B to have a size slightly smaller than the inner size of the recess portion 13.

In the present invention, at least one closed space 14, e.g., a closed space extending along the weight member 1B in the toe-heel direction, is formed between the weight member 1B and the surface of the recess portion 13 of the head main portion 1A2. The closed space 14 is surrounded by the weight member and the surface of the recess portion. The closed space 14 in this embodiment is surrounded by the bottom surface 15, which is constituted by substantially a single plane, of the recess portion 13, the inner wall surface 16 of the recess portion 13, and the surface of a dent portion 20*a* formed in the rear surface 20 of the weight member 1B, thus closing the space of dent portion 20*a* to provide the closed space 14.

Such a closed space 14 serves to enhance the degree of freedom of the weight distribution design, since the location of the head's center of gravity G can be adjusted by changing the location and size of the closed space 14. Further, the closed space 14 provides a weight margin applicable to other portions. This additional weight margin can be allocated, for example, to a head bottom portion to achieve a low center of gravity or to increase the moment of inertia and, therefore, it is useful for improving the flight directionality and the flight distance. Since the closed space 14 is not visible externally, it does not spoil the beauty of the club head. Further, foreign matters do not enter the closed space during playing.

Figure 7:
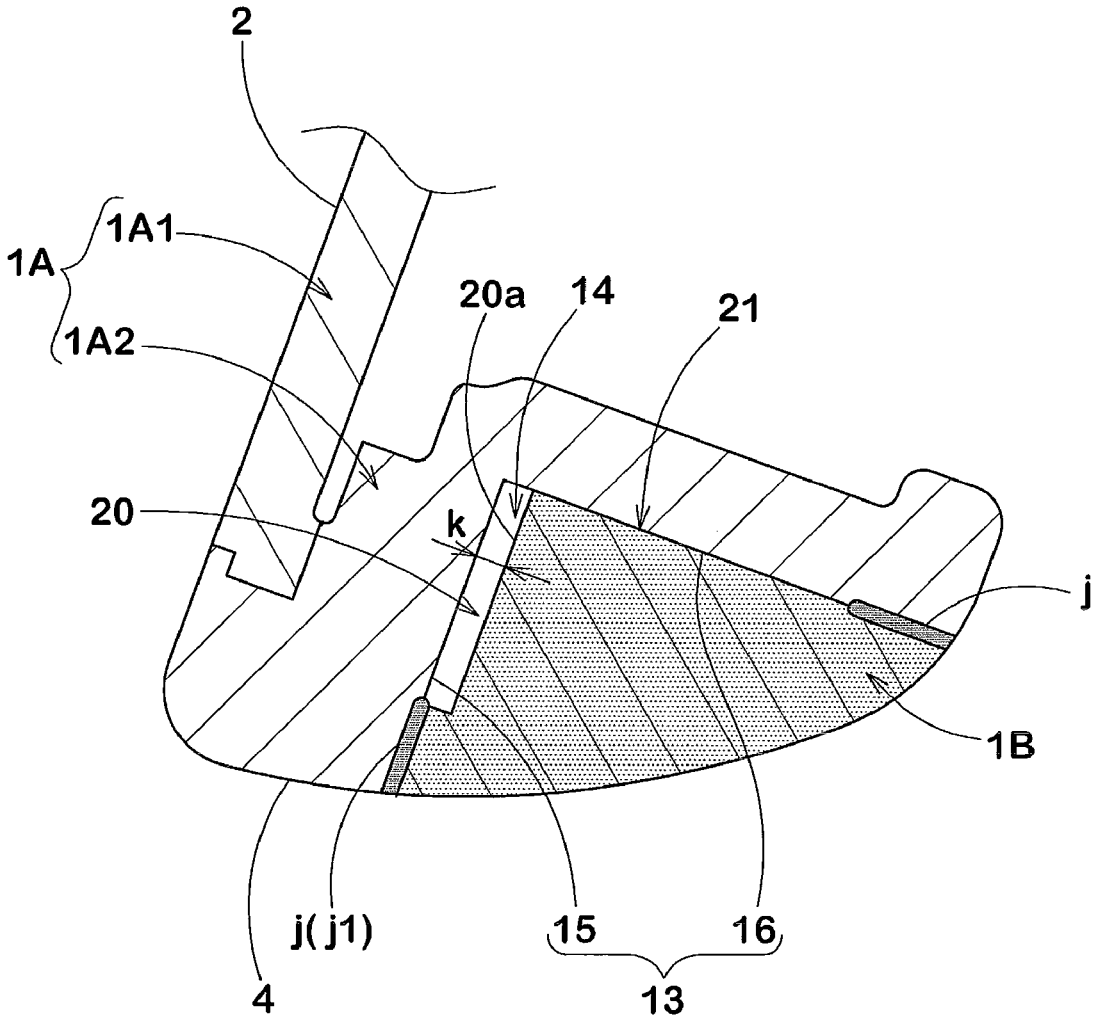
FIG. 7 is a partially enlarged view of FIG. 3.

Further, the closed space 14 reduces the area of a contact surface between the weight member 1B and the surface of the recess portion 13. Therefore, for example, in the case that a long and narrow closed space 14 is formed along the bottom surface 15 of the recess portion 13 as shown in FIGS. 2 and 7, a welded part "j1" (solidified product of a molten metal) formed between the bottom surface 15 of the recess portion 13 and the rear surface 20 of the weight member 1B by welding them from the sole 4 side can reach the closed space 14. Therefore, non-welded portion or portions at which the surface of the recess portion 13 and the weight member are in contact with each other but are not welded, can be decreased or completely eliminated. This is useful for improving the durability of the welded portion "j1", since an impact which is apt to be transferred from the head body 1A to the weight member 1B through the non-welded portion at the time of hitting a ball, is reduced and the welded portion is prevented from cracking.

In particular, vibration is easy to be transferred from the bottom surface 15 to the weight member 1B when the face 2 deforms backwardly at the time of hitting a ball. According to the present invention, however, vibration of the weight member 1B can be effectively suppressed by reducing the non-welded portion from the bottom surface 15 as shown, for example, in FIG. 7. From the viewpoint of main hitting area of the face 2, it is preferable to eliminate the non-welded portion from, in other words, to provide the closed space 14 in a region extending from a cross section perpendicular to the face 2 and passing through the sweet spot SS (i.e. A-A line in FIG. 2) toward each of the toe and heel sides by a distance of at least 5 mm, preferably at least 10 mm, more preferably at least 15 mm. Of course, it is the most preferable to completely eliminate the non-welded portion over the full length of the weight member 1B.

Figure 8:
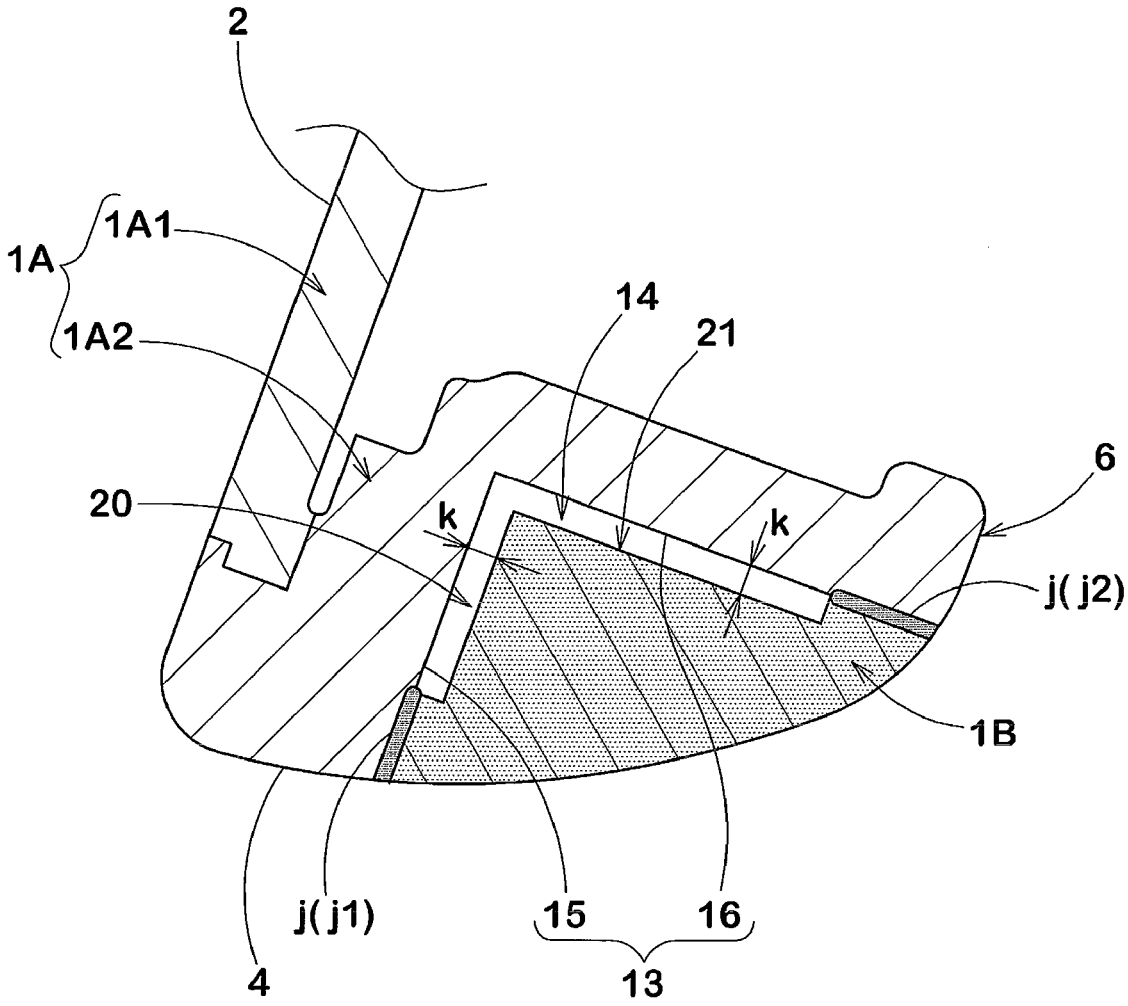
FIG. 8 is a partially enlarged cross sectional view of a golf club head showing another embodiment of the present invention.

Further, in the case that the closed space 14 is provided along both the bottom surface 15 and the inner wall surface 16 as shown in FIG. 8, the welded part "j1" between the bottom surface 15 and the rear surface 20 of the weight member 1B, and a welded part "j2" formed between the inner wall surface 16 of the recess portion 13 and the inside-facing surface 21 of the weight member 1B by welding them from the back face 6 side, both can reach the closed space 14. Therefore, the embodiment shown in FIG. 8 is preferred from the viewpoint that the non-welded portion can be further decreased as compared with the embodiment shown in FIG. 7.

Figure 9:
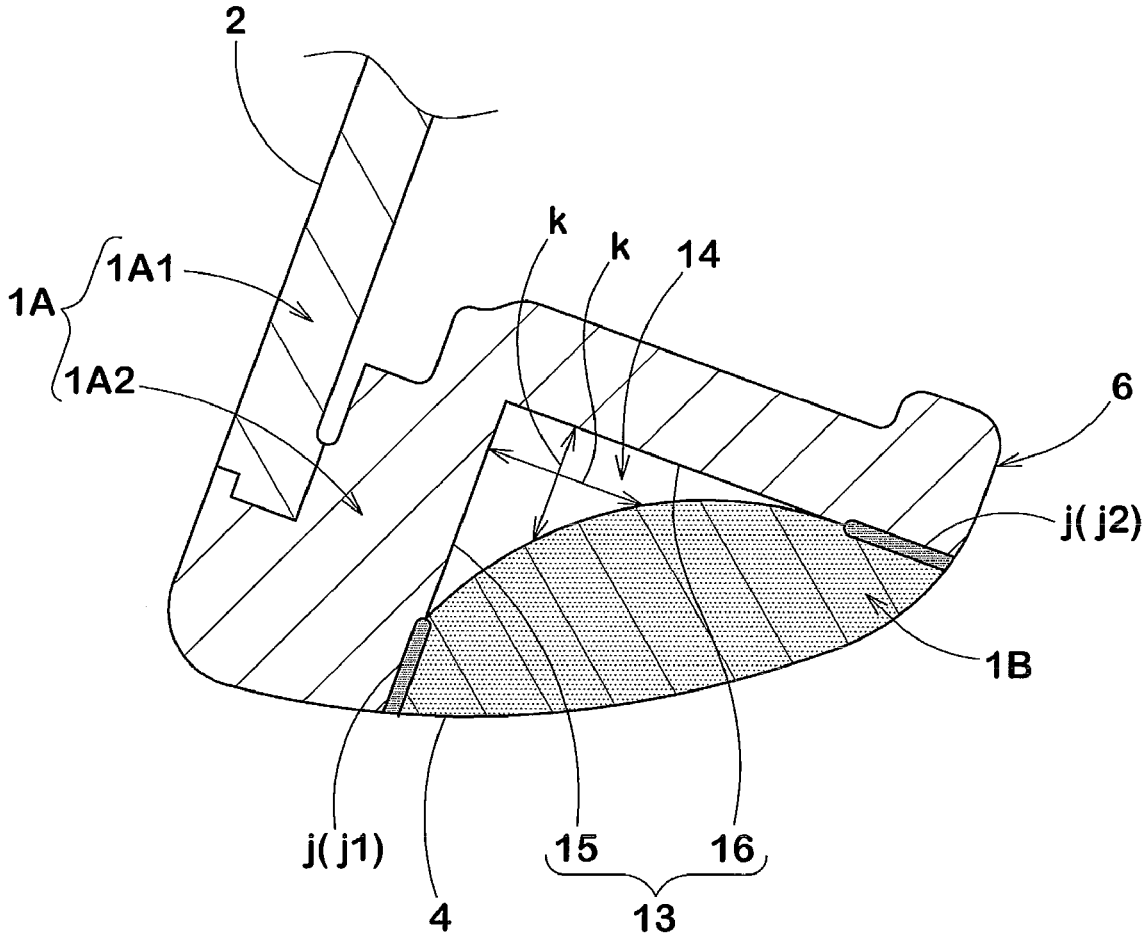
FIG. 9 is a partially enlarged cross sectional view of a golf club head showing still another embodiment of the present invention.

The closed space 14 shown in FIG. 8 has an approximately L-shaped cross section with substantially a constant thickness (gap "k"). Of course, the closed space 14 can have various three dimensional shapes, including cross sectional shapes such as a nearly triangular cross sectional shape as shown in FIG. 9.

The location of the closed space 14 can be arbitrarily determined. Particularly, it is preferable to dispose the closed space 14 on a head bottom side that the head 1 is easy to come into contact with the ground at the time of swing, specifically on a head bottom side of the sweet spot SS as in the embodiments shown in FIGS. 1 to 9.

The volume of the closed space 14 is preferably at least 0.05 $cm^3$, more preferably at least 0.07 $cm^3$, still more preferably at least 0.10 $cm^3$. If the volume of the closed space 14 is too small, non-welded portion at which the recess portion 13 and the weight member 1B are in contact with each other but are not welded together, cannot be sufficiently reduced, so the durability of a welded portion cannot be sufficiently improved. It the volume is too large, there is a possibility that the effect of weight distribution design produced by the weight member 1 is reduced. Therefore, the volume of the closed space 14 is preferably at most 1.5 $cm^3$, more preferably at most 1.0 $cm^3$, still more preferably at most 0.5 $cm^3$.

The closed space 14 provides a non-contact portion between the recess portion 14 and the weight member 1B. The larger the area of the non-contact portion, the more noticeably the above-mentioned effect is exhibited. From such a point of view, it is preferable that the ratio S2/S1 is at least 0.15, especially at least 0.20, wherein S1 denotes the total area of facing surfaces between the recess portion 13 and the weight member 1B (this area S1 being calculated from the area of the facing surface of either one of the recess portion 13 and the weight member 1B and including the area of a portion at which one is not in contact with the other through the closed space 14), and S2 denotes the total surface area of non-contact portions at which the recess portion 13 and the weight member 1B face each other through the closed space 14 (this area S2 being calculated from either one of the recess portion 13 and the weight member 1B which has been used for the calculation of the area S1). If the S2/S1 ratio is too large, the area of the welded portion between the recess portion 13 and the weight member 1B is small and the adhesion strength tends to lower. Therefore, it is preferable that the S2/S1 ratio is at most 0.70, especially at most 0.50.

If the gap "k" (which is the minimum distance of a spacing between the recess portion 13 and the weight member 1B) of the closed space 14 is too small, the recess portion 13 and the weight member 1B which are not in contact with each other under static condition due to the presence of the closed space 14, may come into contact with each other due to deformation of the head body 1A by ball hitting impact, thus transferring the impact to the weight member 1B. Therefore, it is preferable that the closed space 14 has a gap "k" between recess portion 13 and weight member 1B of at least 0.1 mm, especially at least 0.3 mm, more especially at least 0.5 mm. In the case that the closed space 14 is disposed on a head bottom side of the sweet spot SS of the head 1, it is preferable from the view point of low center of gravity that the gap "k" is at most 3.0 mm, especially at most 2.0 mm, more especially at most 1.5 mm.

From the same point of view, it is preferable that the ratio S3/S1 is at least 0.10, especially at least 0.15, more especially at least 0.20, and is at most 0.70, especially at most 0.50, wherein S1 denotes the total area of facing surfaces as defined above, and S3 denotes the total area of non-contact portions having a gap "k" of at least 0.50 mm between the recess portion 13 and the weight member 1B.

Figure 10A:
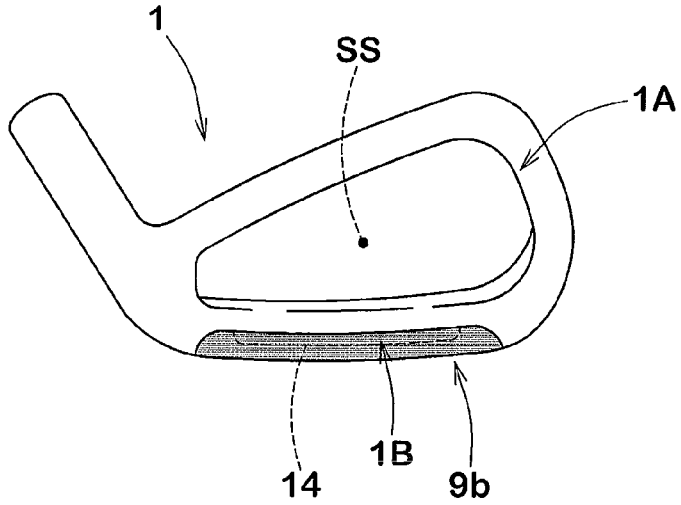
FIGS. 10A, 10B and 10C are back views of golf club heads illustrating another examples of the weight member.
Figure 10B:
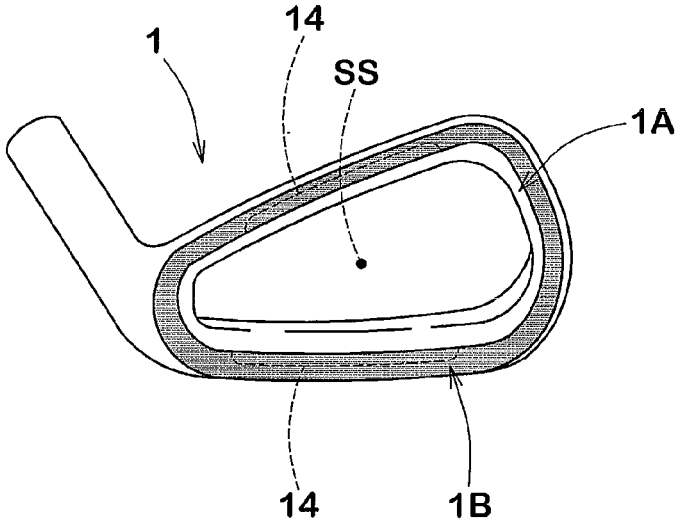

The shapes of the weight member 1B and the recess portion 13 are not limited to those explained above, and various shapes are applicable. For example, the weight member 1B may have such a shape as extending in the toe-heel direction only within the region of the sole frame part 9*b* as shown in FIG. 10A, or such an annular shape as extending continuously at a peripheral portion of the face as shown in FIG. 10B. The recess portion 13 is formed into a shape to which the weight member 1B used is attachable.

Figure 11A:
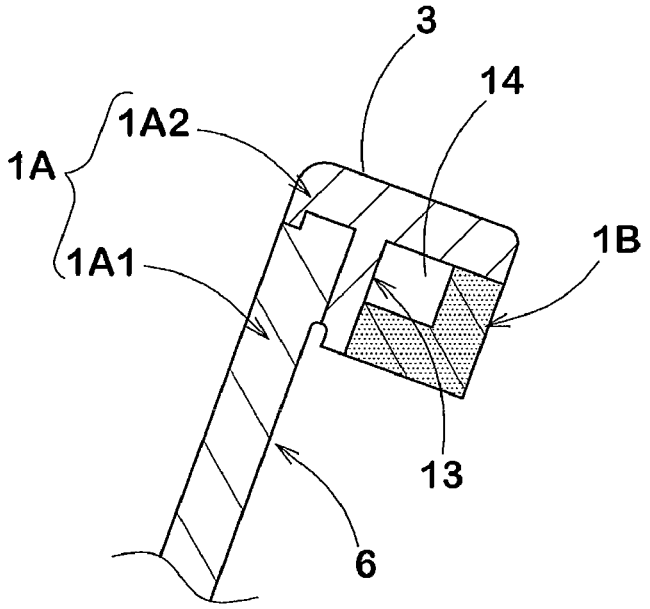
FIGS. 11A and 11B are partially enlarged cross sectional views of golf club heads showing another embodiments of the present invention.
Figure 11B:
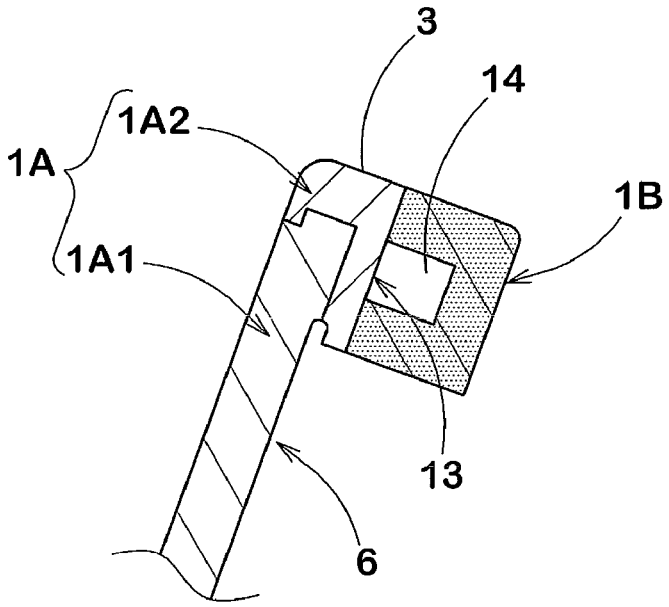

In case that the weight member 1B is disposed on a head top side of the sweet spot SS as shown in FIG. 10B, the closed space 14 may be provided on the head top side of the sweet spot SS of the head 1. Examples of such a closed space 14 disposed on the top side are shown in FIGS. 11A and 11B. In these cases, the center of gravity G can be further lowered since the weight of the head top side is decreased. Therefore, it is particularly preferable to dispose the closed spaces 14 on both the head top side and the head sole side of the sweet spot SS.

Figure 10C:
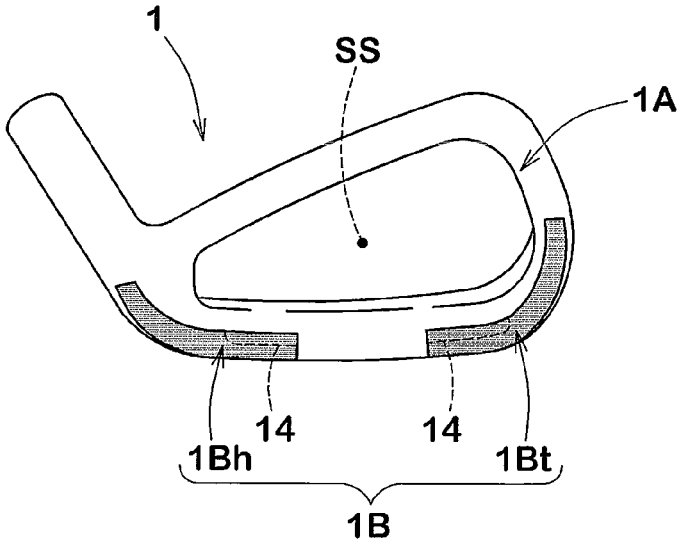

The weight member 1B may be divided into two or more portions and separately attached to the head body 1A, as shown in FIG. 10C. In the embodiment shown in FIG. 10C, the weight member 1B includes a toe side weight member 1Bt and a heel side weight member 1Bh. The closed spaces 14 are provided, for example, at locations within the hitting area.

An example of a method for producing the club head 1 of the present invention is explained below.

Firstly, the face member 1A1, the head main portion 1A2 and the weight member 1B are separately prepared. These can be prepared by various methods, e.g., casting, forging, and plastic deformation work such as press work. For example, the face member 1A1 is prepared by press molding, and the head main portion 1A2 and the weight member 1B are prepared by casting. The face member 1A1 and the head main portion 1A2 may, of course, be integrally formed.

Figure 3:
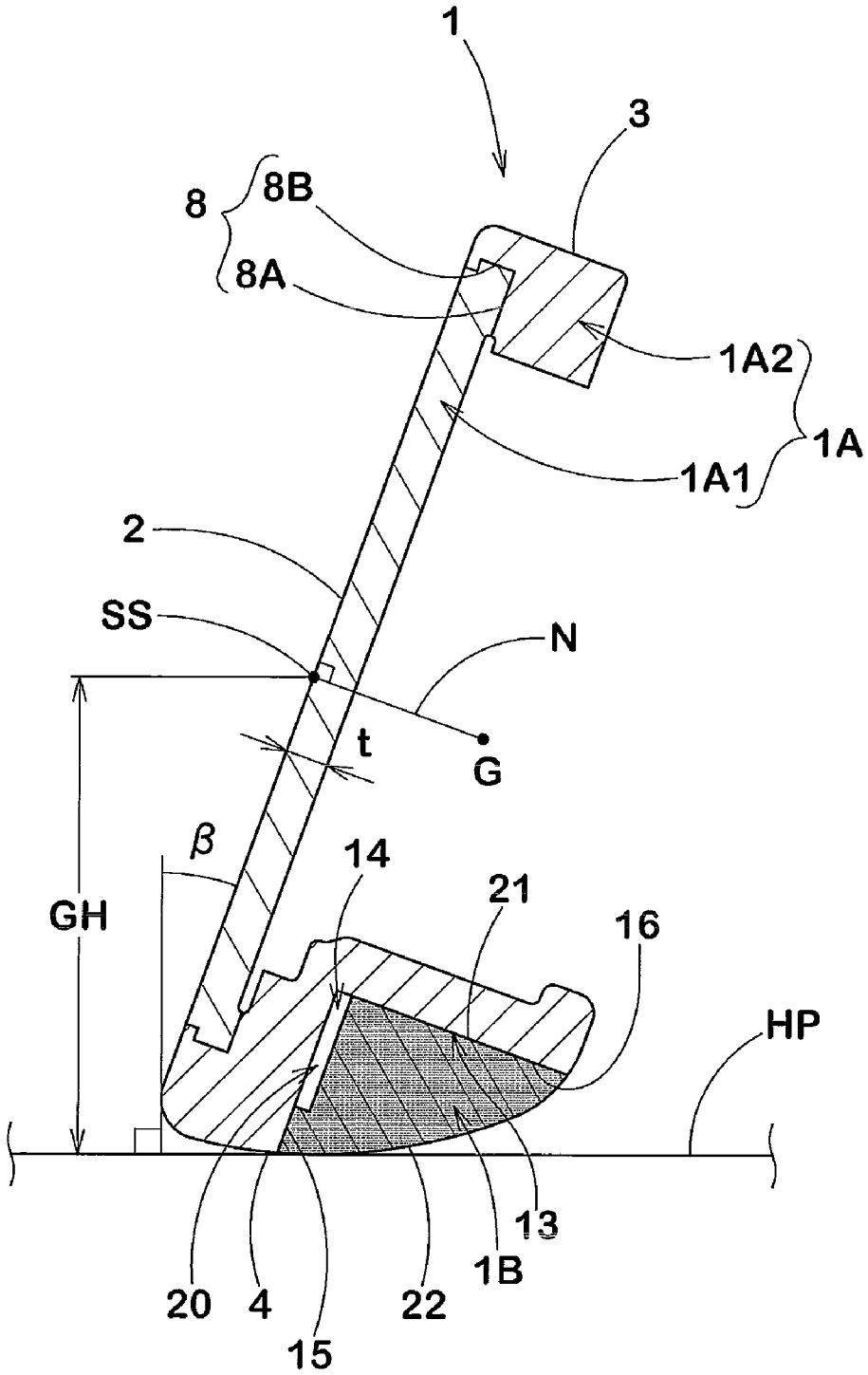
FIG. 3 is an enlarged cross sectional view along the line A-A of FIG. 2.
Figure 4:
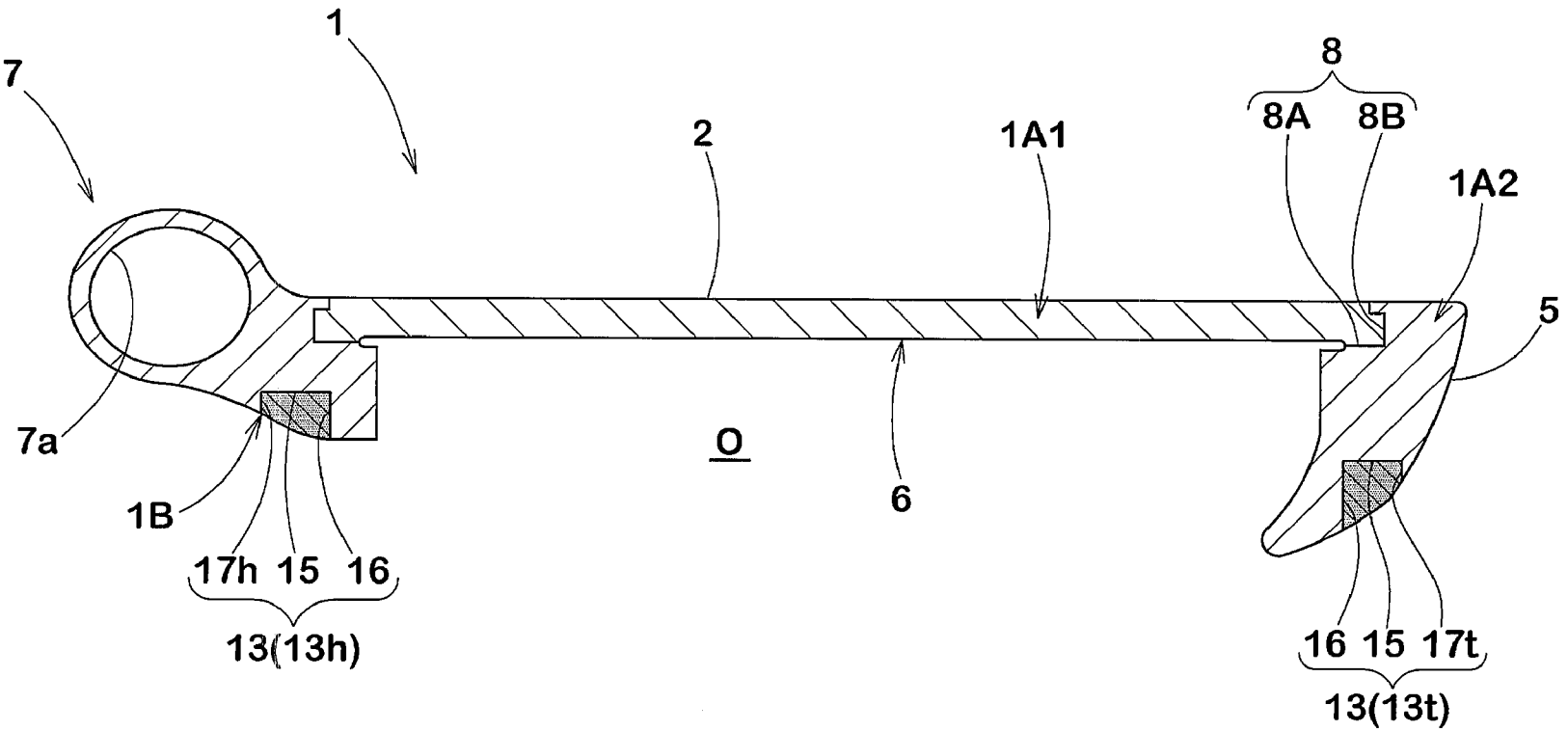
FIG. 4 is an enlarged cross sectional view along the line B-B of FIG. 2.

A step of preparing a temporary assembly 1T of the club head is then carried out by fitting the weight member 1B into the recess portion 13 of the head main portion 1A2. As shown in FIGS. 3 and 5, the center recess portion 13 is not provided with an outer wall (outer wall surface 17) so that the sole frame part 9*b* is partly opened toward the bottom of the head. Therefore, the weight member 1B can be easily inserted into the recess portion 13 to improve the workability. On the other hand, since the heel side recess portion 13*h* and the toe side recess portion 13*t* each is provided with the bottom surface 15, the inner wall surface 16 and the outer wall surface 17*h* or 17*t*, the weight member 1B is supported on three sides at each of its heel and toe side portions. Therefore, the joining state between the head main portion 1A2 and the weight member 1B is stable, so displacement and detachment are prevented from occurring at the time of temporary assembling without impairing the fitting easiness.

Figure 12:
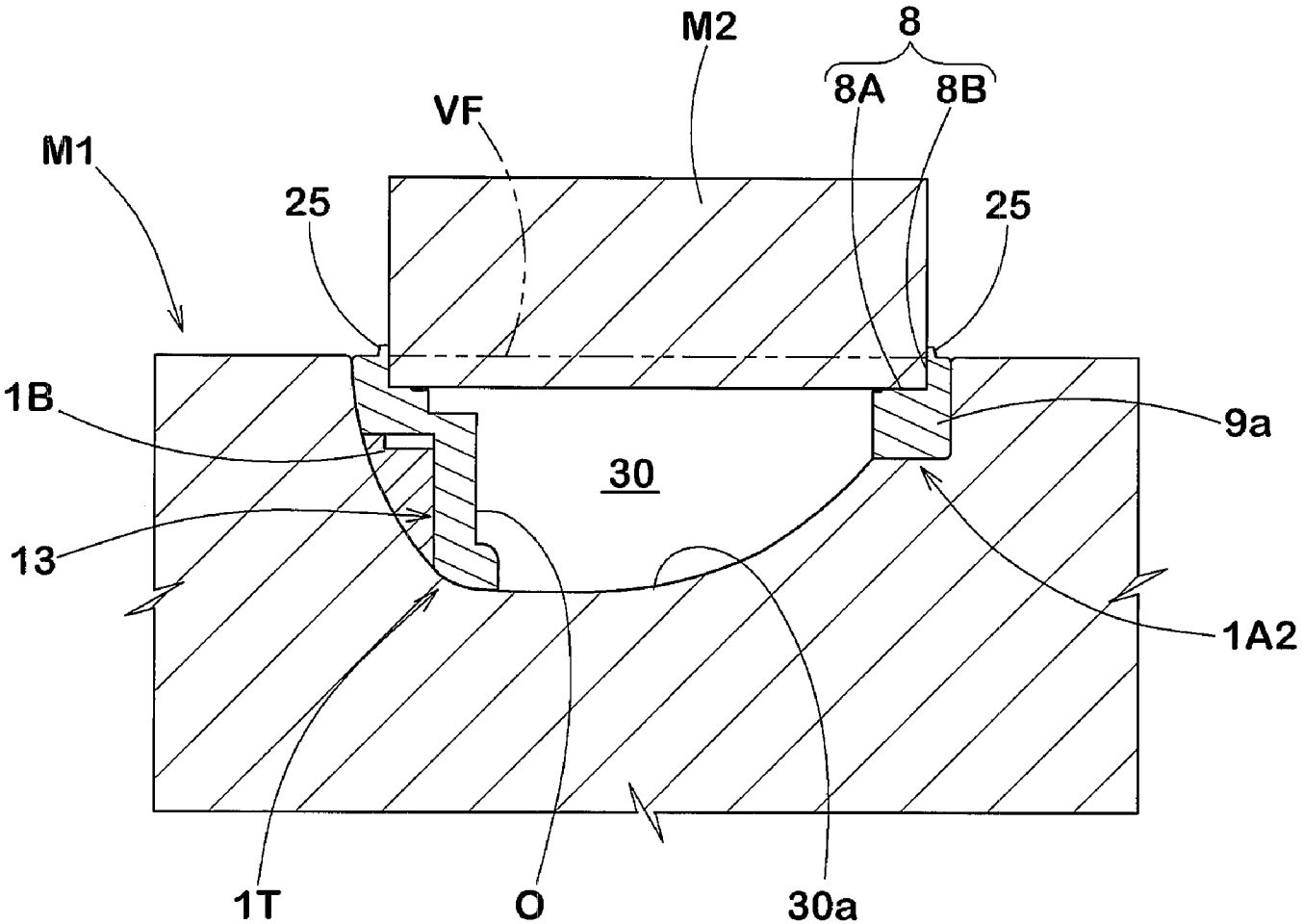
FIG. 12 is a cross sectional view showing an example of a step of rectifying a joint surface between a head body and a weight member.

A step of rectifying the surfaces to be joined together is then conducted by applying a pressure to the temporary assembly 1T by a press, as shown in FIG. 12, so as to cause plastic deformation of at least a part of the weight member 1B and the recess portion 13 to thereby bring the contact surfaces between them into more close contact with each other.

For this purpose, for example, the temporary assembly 1T is placed in a metallic female mold M1 having a cavity 30 so that the back face side of the assembly 1T faces downward and the face side thereof faces upward. The face 2 or a virtual face VF which turns into the face 2 later is kept substantially in a horizontal position. The cavity 30 has an inner surface 30*a* substantially identical with the outer surface or contour of the back face side of the finished head 1, whereby the female mold M1 can support the temporary assembly 1T without any substantial movement of the assembly 1T. A male mold M2 is then pressed against the whole receiving surface 8A of the face-fitting portion 8A. For example, the male mold M2 is connected to a fluid pressure actuator (not shown) or the like so as to apply a force vertically and downwardly to the assembly 1T. Thus, the temporary assembly 1T is compressed between the female and male molds M1 and M2 so that the recess portion 13 of the head main portion 1A2 and the weight member 1B tightly contact each other. At that time, either one with a lower strength of the head main portion 1A2 and the weight member 1B, or at least a part of them, undergoes plastic deformation, whereby a gap which may present at the interface between them or looseness is reduced to achieve a more close contact of the both members 1A2 and 1B.

In general, separately prepared two members have an unavoidable production error, respectively. Therefore, displacement of the both members is easy to occur when they are fitted to each other prior to welding them, or there may occur a case that the surfaces to be joined together do not sufficiently come into contact with each other, so the fitting position is not stabilized. If welding is conducted in such a state, a gap remains between the both members, thus causing cracking of a welded part since vibration of the head body 1A may transfer to the weight member 1B through the gap. In contrast, when the step of rectifying the contact surfaces of the head body 1A and the weight member 1B is conducted as in the embodiment explained above, the fitting state of the weight member 1B to the recess portion 13 is stabilized and they can be welded in the state that the contact surfaces are brought into close contact with each other. This is useful for further improving the durability of the joint part.

Figure 13:
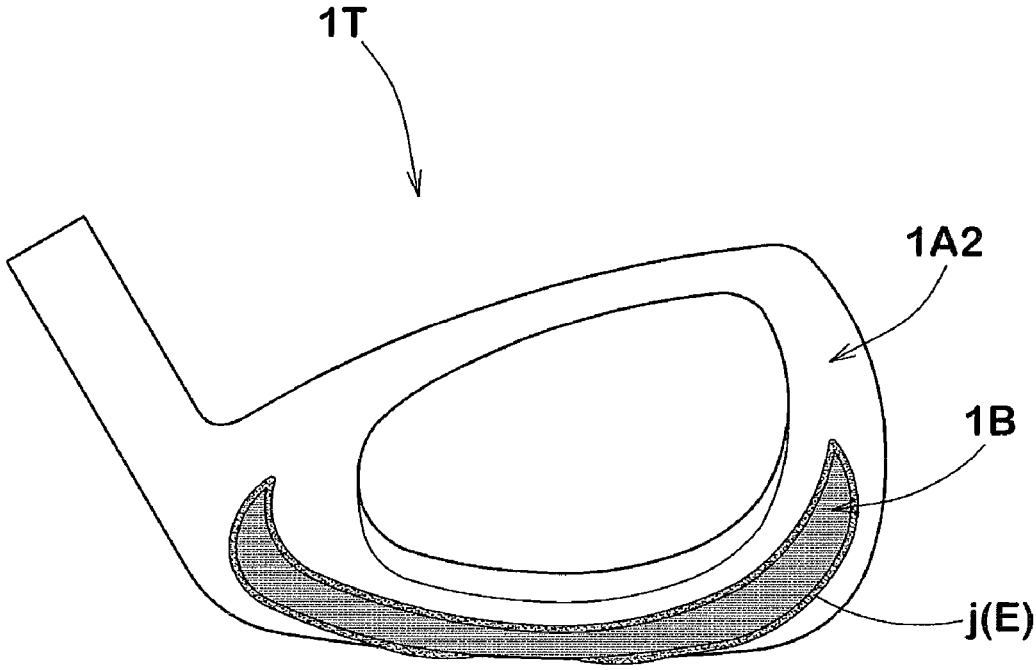
FIG. 13 is a back view of a temporary assemble obtained after a welding step.

After the joint surface-rectifying step, the temporary assembly 1T is then taken out from the mold, and a welding step is conducted wherein a boundary part E between the head main portion 1A2 and the weight member 1B is welded to give a welded part "j", the boundary part E appearing at the outer surface of the assembly 1T as shown in FIG. 13. The welding can be conducted by various known methods. For example, TIG welding, plasma welding, laser welding and soldering are preferable.

Figure 14:
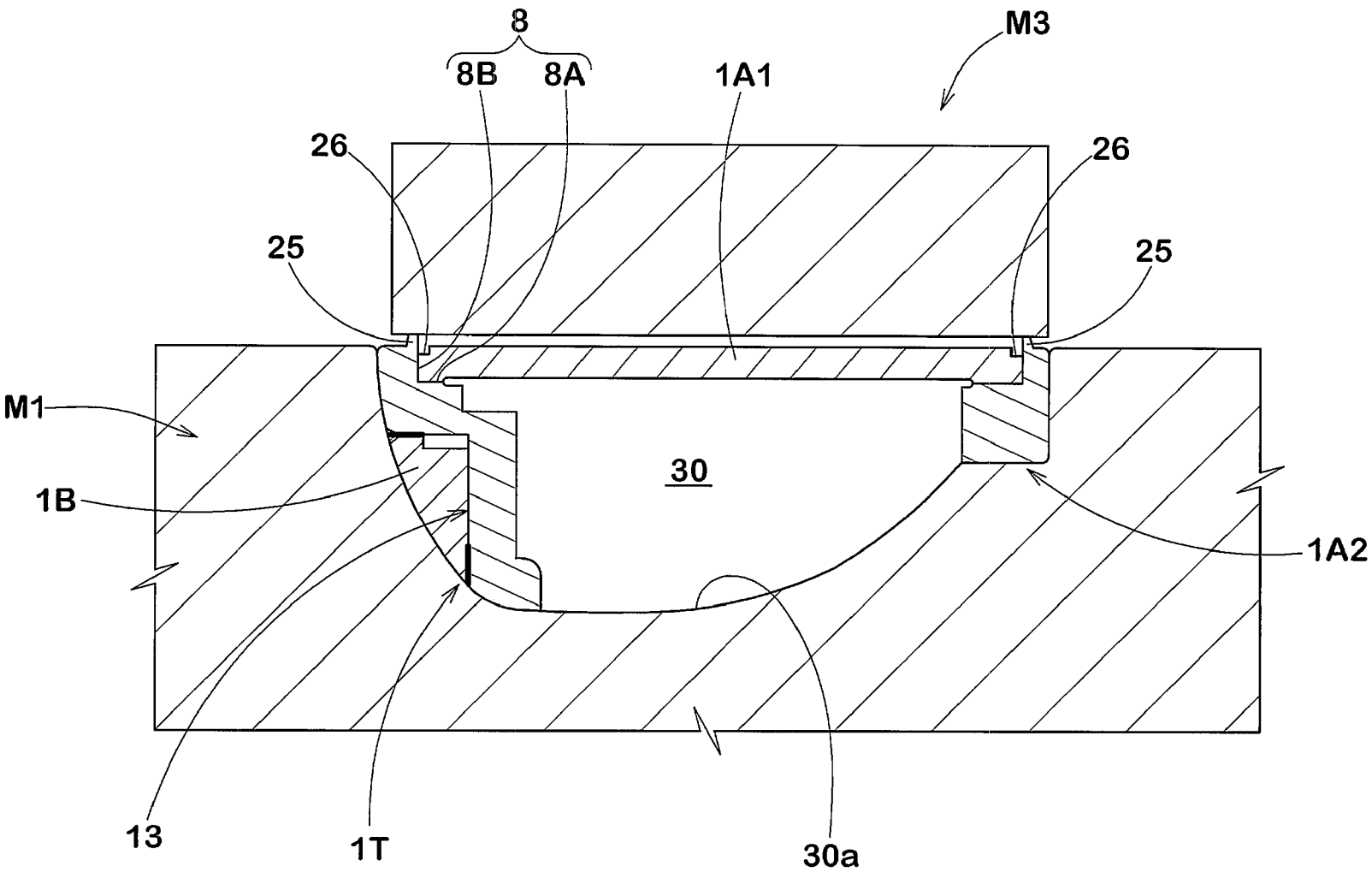
FIG. 14 is a cross sectional view showing a step of fitting a face member.

After conducting the welding step, a face-fitting step is conducted wherein the face member 1A1 is joined to the face-fitting portion 8A of the head main portion 1A2. In the face-fitting step is used the same female mold M1 as that used in the joint surface-rectifying step, as shown in FIG. 14. The welded temporary assembly 1T is placed in the cavity 30 of the female mold M1, and the face member 1A1 is fitted onto the face-fitting portion 8A of the assembly 1T.

Preferably, a projecting part 25 is previously provided at the periphery of the face-fitting portion 8A and, on the other hand, a groove-like cut away part 26 is annularly formed at the edge of the front surface of the face member 1A1. When the projecting part 25 is flattened out by a punch M3, the deformed projecting part 25 gets into the annular cut away part 26, thus the face member 1A1 and the head main portion 1A2 are swaged together.

The club head 1 of the present invention can also be produced by firstly attaching the face member 1A1 to the head main portion 1A2 and then fitting and welding the weight member 1B to the recess portion 13 of the head main portion 1A2. However, in this case, the metallic structure of the face member 1A1 may be thermally changed by the heat of welding, so the durability and the repulsion property tend to be impaired. In case of the method as explained above, there is no such a problem.

Attachment of the face member 1A1 to the head main portion 1A2 by non-welding joining such as swaging or crimping is advantageous from the viewpoint that the joint strength of the welded part "j" between the weight member 1B and the recess portion 13 which are preferably joined together prior to attaching the face member 1A1, is prevented from lowering by a heat of welding. The non-welding joining includes, for instance, press fitting besides swaging or crimping. Of course, the non-welding joining may be used in combination with an adhesive.

After joining the face member 1A1, the obtained club head is then subjected to a finishing step such as polishing and coating to give the club head 1.

While a preferable embodiment of the present invention has been described, it goes without saying that the present invention is not limited thereto and various changes and modifications may be made.

The present invention is more specifically described and explained by means of the following Examples and Comparative Examples. It is to be understood that the present invention is not limited to these Examples.

EXAMPLES 1 TO 3 AND COMPARATIVE EXAMPLE 1

Iron-type golf club heads were prepared based on the specifications shown in Table 1, and the performances thereof were measured. These club heads were prepared in such a manner as firstly separately preparing a face member, a head main portion and a weight member, fitting the weight member to the head main portion and compressing them by a press to rectify the joint surface, joining them by plasma welding, fitting the face member to the head main portion and joining them by swaging.

Figure 15A:
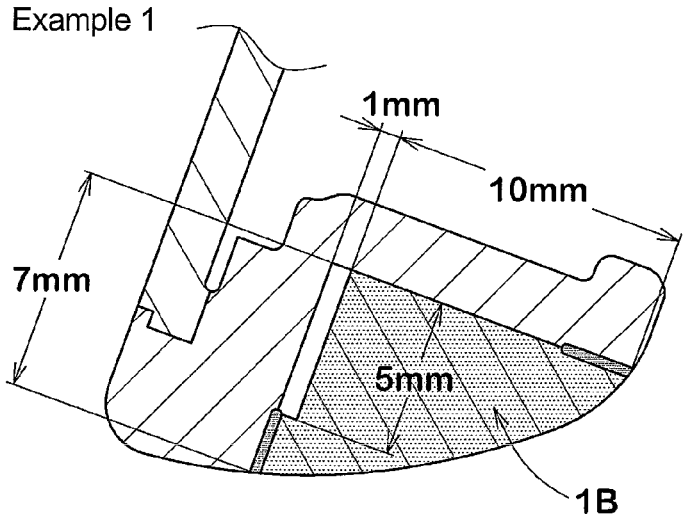
FIGS. 15A, 15B and 15C are partially enlarged cross sectional views of iron-type golf club heads prepared in Examples 1, 2 and 3 described after.
Figure 15B:
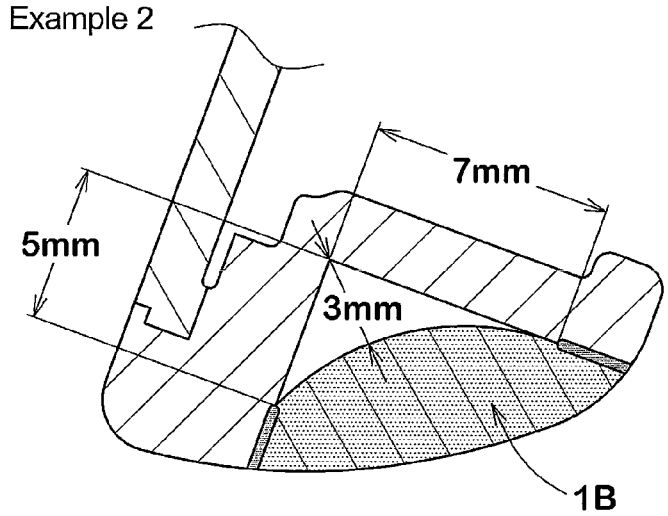
Figure 15C:
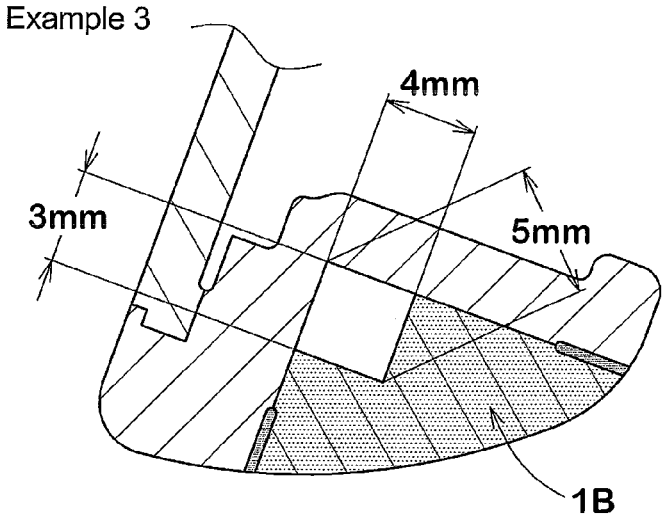
Figure 16A:
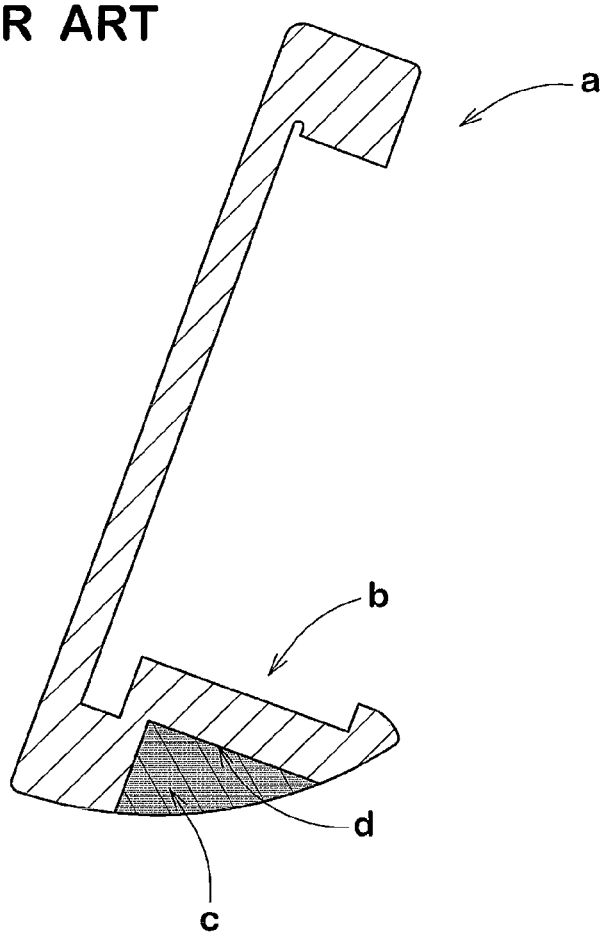
FIG.16A PRIOR ART
FIGS. 16A and 16B are cross sectional views of a conventional iron-type golf club head.
Figure 16B:
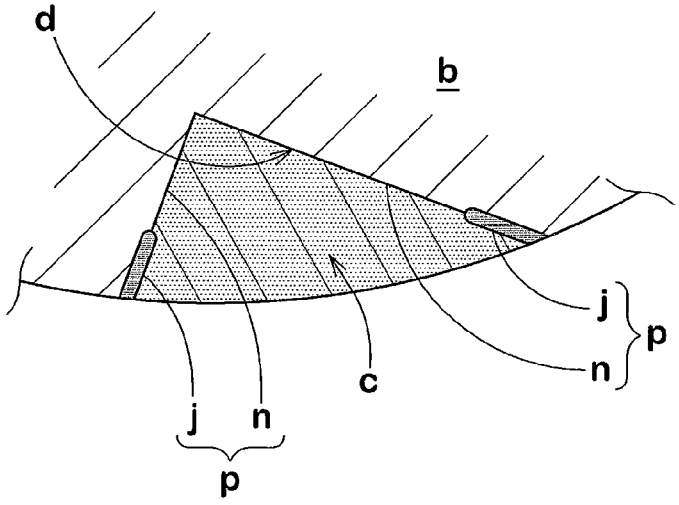
FIG.16B PRIOR ART

In Examples 1 to 3, a closed space was provided on a sole side. The vertical cross section views passing through the sweet spot of the club heads prepared in Examples 1 to 3 are shown in FIGS. 15A to 15C, respectively. The horizontal length (length in the toe-heel direction) of the closed space was about 35 mm, and the depth of penetration of weld bead was about 3 mm. In Comparative Example 1, no closed space was provided to have a structure as shown in FIG. 16B. In Examples 1 to 3, the weight reduced by formation of the closed space was allocated to toe and heel sides by attaching another members different from the weight member so that the total weight becomes identical to that of the club head of Comparative Example 1.

The specifications other than those shown in Table 1 are common to all Examples and are as described below.

No. of club head: 3-iron, loft angle 20°, lie angle 59.5°

Material of head main portion: casting product of SUS 630

Specific gravity of head main portion: 7.8

Material of face member: press molding product of Ti-6Al-4V alloy

Specific gravity of face member: 4.42

Weight of face member: 35 g

Material of weight member: casting product of tungsten alloy (W: 20 wt %, Fe: 15 wt %, Ni: 60 wt %, Cr: 3 wt %, residue: C, Si, Mn, N, etc.)

Specific gravity of weight member: 9.5

Iron-type golf clubs were prepared by attaching a carbon shaft (model MP 400 made by SRI Sports Limited, flex S) each of the club heads, and were tested with respect to durability, height GH of the center of gravity (see FIG. 3), lateral moment of inertia (moment of inertia about a vertical axis passing through the head's center of gravity), vertical moment of inertia (moment of inertia about a horizontal axis parallel to the face and passing through the head's center of gravity), and depth of center of gravity.

<Durability>

Each of the golf clubs was attached to a swing robot (made by Miyamae Kabushiki Kaisha), and up to 10,000 golf balls commercially available under the trademark "XXIO DC" made by SRI Sports Limited were hit at a head speed of 42 m/s. The presence of damage of the club head was visually observed every 100 shots, and the test was finished when generation of damage was observed.

<Moment of Inertia>

The moment of inertia was measured using Moment of Inertia Measuring Instrument Model No. 005-004 made by INERTIA DYNAMICS INC.

The results are shown in Table 1.

From these results, it is observed that the club heads of the Examples according to the present invention have a low center of gravity and a large moment of inertia and accordingly has a large degree of freedom of design, and they also have an excellent durability.

TABLE 1

| | Example 1 | Example 2 | Example 3 | Com. Ex. 1 |
|---|---|---|---|---|
| Section view of main part of head | FIG. 15A | FIG. 15B | FIG. 15C | FIG. 16B |
| Weight of head main portion (g) | 143.1 | 146.6 | 152.3 | 140.0 |
| Weight of face member (g) | 35.0 | 35.0 | 35.0 | 35.0 |
| Weight of weight member (g) | 56.5 | 52.6 | 48.1 | 60.0 |
| Total weight of head | 235 | 235 | 235 | 235 |
| Volume of closed space between weight member and recess portion of head main portion ($cm^3$) | 0.15 | 0.35 | 0.36 | 0 |
| Total area S1 of facing surfaces between weight member and recess portion ($cm^2$) | 5.1 | 5.1 | 5.1 | 5.1 |
| Total area S2 of surface of non-contact portion between weight member and recess portion ($cm^2$) | 1.8 | 3.6 | 2.1 | 0 |
| S2/S1 ratio | 0.35 | 0.71 | 0.41 | 0 |
| Durability (hitting of up to 10,000 balls) | No damage | No damage | No damage | Cracking at welded part when hitting 3600 balls |
| Height of center of gravity (mm) | 20.1 | 2.03 | 20.3 | 20.1 |
| Lateral moment of inertia ($g \cdot cm^2$) | 2,640 | 2,680 | 2,755 | 2,645 |
| Vertical moment of inertia ($g \cdot cm^2$) | 645 | 705 | 690 | 650 |
| Depth of center of gravity (mm) | 4.8 | 4.8 | 4.7 | 4.8 |

What is claimed is:

1. An iron-type golf club head comprising:

a head body made of at least one kind of metallic material comprising a face member and a head body main portion, the head body having a face for hitting a golf ball and a recess portion, and a weight member made of a metallic material having a specific gravity larger than said at least one kind of metallic material of the head body, the weight member fitted to and covering said recess portion to form a part of an outer surface of the golf club head, wherein said recess portion is formed on said head body main portion and defined by a first surface extending from said outer surface which is substantially parallel to said face and a second surface extending from said outer surface and intersecting with the first surface, the weight member is welded to the first surface and the second surface so that a welded part between the weight member and the first surface extends along a part of the first surface from said outer surface of the golf club head to a first ending position, and a welded part between the weight member and the second surface extends along a part of the second surface from said outer surface of the golf club head to a second ending position, the surface of the weight member opposed to said first surface and said second surface is provided at each of said first ending position and said second ending position with a step extending away from said first and said second surface to form a gap of at least 0.1 mm and at most 3.0 mm extending from the first ending position to the second ending position so as to form a closed space between said recess portion and said weight member, said closed space is formed on a head bottom side of a sweet spot of said head, said second surface intersects with the first surface at a right angle, said gap is substantially constant from the first ending position to the second ending position and substantially same as the sizes of the steps, and the closed space has a L-shaped cross-sectional shape.

2. The golf club head of claim 1, wherein said recess portion has a volume of 0.05 to 1.5 $cm^3$.

3. The golf club head of claim 1, wherein a ratio S2/S1 is from 0.15 to 0.70, wherein S1 denotes a total area of facing surfaces between said recess portion and said weight member, and S2 denotes the total area of surface of non-contact portions at which said recess portion and said weight member face each other through said closed space.

4. The golf club head of claim 1, wherein said recess portion is provided on a back side of said head body.

5. The golf club head of claim 1, wherein said recess portion is provided on a back side of said head body to extend along at least a sole of said head body.

6. The golf club head of claim 1, wherein said closed space extends along said head body proximate to a sole of said head body and has a volume of 0.05 to 1.5 $cm^3$.

7. The golf club head of claim 1, wherein said closed space has a volume of 0.05 to 1.5 $cm^3$.

8. The golf club head of claim 7, wherein a ration S2/S1 of a total area S1 of the facing surfaces of said recess portion and said weight member which facing surfaces confront each other and a total area S2 of non-contact portions of said facing surfaces which non-contact portions confront each other through said gap is in a range of from 0.15 to 0.70.

* * * * *